United States Patent [19]

Valenziano et al.

[11] 4,048,779

[45] Sept. 20, 1977

[54] TURNBUCKLE CONNECTOR USEABLE IN A METHOD FOR REPLACING AN EXISTING UTILITY POLE WITHOUT DISTURBING HARDWARE MOUNTED THEREON

[75] Inventors: Frank P. Valenziano, Summit; Daniel E. Olivier, Bedminster, both of N.J.

[73] Assignee: Interpace Corporation, Parsippany, N.J.

[21] Appl. No.: 682,758

[22] Filed: May 3, 1976

Related U.S. Application Data

[63] Continuation-in-part of Ser. No. 606,073, Aug. 20, 1975, which is a continuation-in-part of Ser. No. 511,173, Oct. 2, 1974, Pat. No. 3,911,548.

[51] Int. Cl.[2] ..... E04C 3/30; E02D 35/00

[52] U.S. Cl. ..... 52/726; 52/40; 52/127; 52/514; 29/401 F; 174/45 R

[58] Field of Search ..... 52/40, 721, 720, 726, 52/733, 127, 514; 248/58, 59; 29/401, 426, 427, 464; 174/45 R; 403/43, 44, 45, 46, 48

[56] References Cited

U.S. PATENT DOCUMENTS

| | | | |
|---|---|---|---|
| 488,274 | 12/1892 | Gray | 52/721 |
| 582,079 | 5/1897 | McClintic | 52/726 |
| 1,065,408 | 6/1913 | Thorsby | 403/44 |
| 2,607,450 | 8/1952 | Horowitz | 52/721 |
| 3,538,237 | 11/1970 | Hockaday | 174/45 R |
| 3,911,548 | 10/1975 | Perry | 52/40 X |

FOREIGN PATENT DOCUMENTS

| | | | |
|---|---|---|---|
| 611,100 | 6/1926 | France | 52/726 |
| 520,135 | 2/1921 | France | 52/726 |

*Primary Examiner*—Price C. Faw, Jr.
*Assistant Examiner*—Robert C. Farber
*Attorney, Agent, or Firm*—Charles E. Baxley

[57] ABSTRACT

This disclosure teaches a turnbuckle connector useful in a method for replacing an existing utility pole (usually wood), without disturbing hardware mounted thereon. As taught in United States patent No. 3,911,548, the utility pole includes a proximal section having a bottom end attached to the earth and a distal section having hardware mounted thereon. The distal section (with its hardward intact thereon) is severed from the proximal section. A new pole section (preferably of prestressed concrete) is attached to the earth appropriately located and adapted for receiving the distal section. The distal section then is connected to project from the new pole section by means of the turnbuckle connector disclosed herein. A plurality of girdle plates, each having side marginal flanges and a terminal flange, are arranged about at least one of the sections to be connected. Turnbuckles connect the side marginal flanges of adjacent girdle plates of each section to draw them toward each other so that the section is gripped. Adjustable fixed connection of flanges of the two sections is provided by means of bolts through slotted bolt holes. One section can be gripped by means of turnbuckles and the other section (usually prestressed concrete) can be gripped by means of grout or other conventional gripping means.

8 Claims, 5 Drawing Figures

TURNBUCKLE CONNECTOR USEABLE IN A METHOD FOR REPLACING AN EXISTING UTILITY POLE WITHOUT DISTURBING HARDWARE MOUNTED THEREON

CROSS REFERENCE

This is a continuation-in-part application with respect to copending U.S. Pat. application 606,073 filed Aug. 20, 1975, which in turn was a continuation-in-part application with respect to U.S. Pat. application 511,173 filed Oct. 2, 1974 which issued on Oct. 14, 1975 as U. S. Pat. 3,911,548. All of these applications and patent are owned by the same assignee, Interpace Corporation.

BACKGROUND OF INVENTION

As has been pointed out in U.S. Pat. 3,911,548, utility poles are subject to damage and deterioration, so it is desirable to provide for convenient replacement thereof.

Hardware connections to distal ends of utility poles represent expensive equipment and highly skilled workmanship, performed sometimes in hazardous conditions. Accordingly it is desirable to replace utility poles in such a way as to avoid necessity for reworking such hardware and to avoid interruptions of service resulting therefrom. Convenient and inexpensive means also have been desirable to alter the elevation and/or alignment of such hardware relative to the earth.

Availability of materials for utility poles and economics relating thereto dictates frequently that a new pole section be of a different material (such as wood, steel, aluminum, prestressed or reinforced concrete or resin bonded glass fibers) from that of the existing utility pole which is being replaced.

BRIEF STATEMENT OF INVENTION

The present invention solves the stated problems and other problems of the prior art in a useful, novel, unobvious and particularly facile way. A turnbuckle connector is provided for use in a method for replacing an existing utility pole, without disturbing hardware mounted thereon. In this method the utility pole comprises a proximal section having a bottom end attached to the earth and a distal section having hardware thereon. The distal section of the existing pole (with the hardware intact thereon) is severed from the proximal section of the existing pole. A new pole section is attached to the earth. The distal section is then connected to project from the new pole section. The turnbuckle connector according to this invention includes a plurality of girdle plates each having a side marginal flanges and a terminal flange. The girdle plates may be arranged about one or both of the sections to be connected. Turnbuckles connect the side marginal flanges of adjacent girdle plates drawing them toward each other to grip a section. Adjustable fixed connection of flanges of the two sections is provided by means of bolts through slotted bolt holes. This turnbuckle connector is particularly useful with wooden sections, it is also useful on concrete to wood connections with grouting employed to grip concrete to the connector.

The new pole section may have a length substantially the same as the proximal section of the existing utility pole, whereby the electrical hardware will be restored approximately to its original elevation above the earth. Or the new pole section may have a different length from that of the proximal pole section, whereby the elevation of the electrical hardware may be changed.

The proximal section may first be severed from the earth so as to leave a stump section protruding from the earth and so as to define a bottom end of the proximal section. Then the proximal section may be arranged vertically adjacent the stump section with the bottom end of the proximal section on the earth for supporting temporarily the distal section. During the severing of the distal section from the proximal section and the connecting of the distal section to the new pole section, the distal section is supported independently for example by means of a crane.

The new pole section can be of any otherwise suitable pole material (including but not necessarily limited to wood, steel, aluminum, prestressed or reinforced concrete or resin bonded glass fibers) as can be the existing pole (but which in most instances is made of wood). Preferably the new pole section is of prestressed concrete and formed hollow so that among other things a grounding line between a distal section and the earth may be provided therewithin.

Hydraulic jacking is a convenient way of removing the stump section and the hole vacated thereby (with or without augering) is useful for implanting a new pole section therein.

The new pole section can be erected adjacent the old pole and, after severing the distal section (with the hardware intact thereon) from the proximal section of the old pole, the distal section can be mounted on the new pole section. Thereafter the proximal section of the old pole can be removed.

Accordingly one object of this invention is to allow convenient, inexpensive, rapid and safe replacement of damaged or deteriorated utility poles.

Another object of this invention is to allow replacement of utility poles without having to rework hardware thereon and without interruption of service.

Still another object of this invention is to provide for convenient altering of the height and/or alignment of hardware on the utility pole.

Still another object of this invention is to accommodate use of a same material or an otherwise suitable different material for new pole sections relative to the material of the existing pole.

Still another object of this invention is to allow for the proximal section of the existing pole first being severed from the earth, so as to leave a stump section protruding from the earth, and so as to define a bottom end of the proximal section. Then the proximal section may be arranged vertically adjacent the stump section with the bottom end of the proximal section on the earth for supporting temporarily the distal section.

Still another object of this invention is preferably to use new pole sections of prestressed concrete which may be made hollow and which can accommodate therewithin a connecting line between the distal section and the earth to provide positive grounding to the earth.

Still another object of this invention is to provide a turnbuckle connector having a plurality of girdle plates each having side marginal flanges and a terminal flange. The girdle plates are arranged about at least one of the sections to be connected. Turnbuckles connect the side marginal flanges of adjacent girdle plates drawing them toward each other to grip that section.

BRIEF DESCRIPTION OF DRAWINGS

The foregoing and other objects, features and advantages will appear more fully from accompanying drawings, viewed in conjunction with a detail description of a preferred embodiment of this invention and viewed with claims which follow. In the drawings same numerals refer to like elements throughout and:

DESCRIPTION OF PREFERRED EMBODIMENTS

As taught in U. S. Pat. No. 3,911,548, and more particularly in FIGS. 1–8 thereof taken in sequential order, a method is illustrated for replacing a damaged or deteriorated utility pole having a proximal section attached to the earth and a distal section 14 having hardware 15 thereon and on which utility wires 16 are strung. Replacement of the pole does not require disturbing of the hardware 15 on the distal section 14 and replacement of the pole can be accomplished readily without any interruption of service, as described in U.S. Pat. No. 3,911,548.

Figure 1:
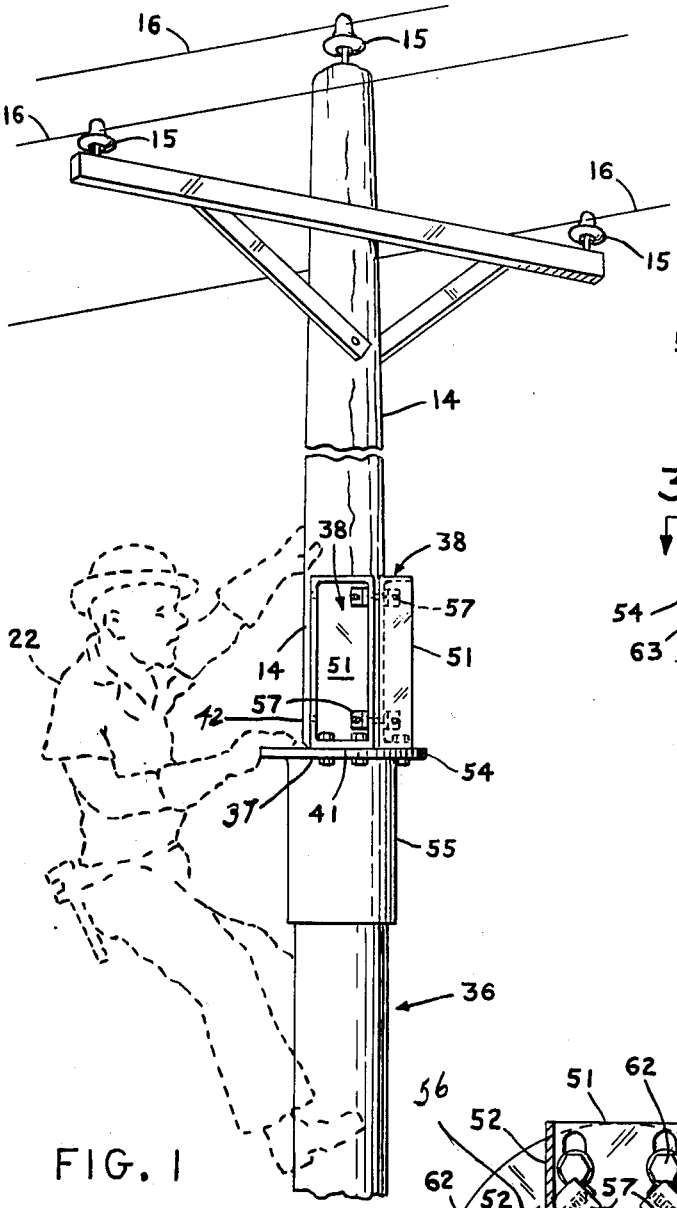
FIG. 1 is a schematic illustration (comparable to FIG. 6 of U. S. Pat. No. 3,911,548) of a distal section of a pole with its hardware intact thereon being positioned atop a new pole section. A truck boom (not shown) could be a means to accomplish this positioning.
Figure 2:
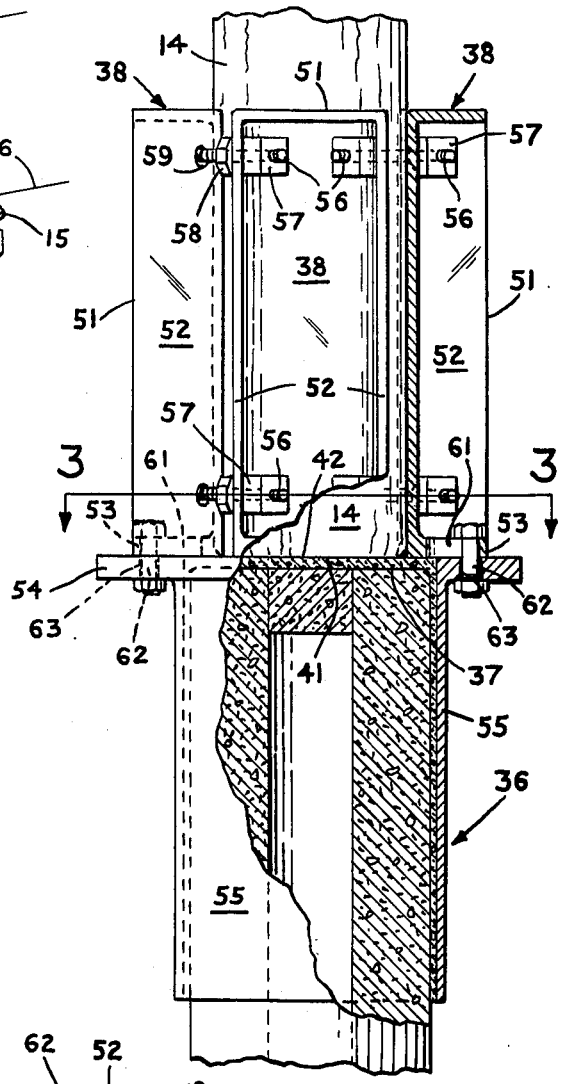
FIG. 2 is a partially broken sectional view of a first embodiment of a turnbuckle connector according to this invention and provided with girdle plates and turnbuckles for a wooden distal section, with the turnbuckle connector attached to a concrete new pole section by means of casting or grouting.

As seen in FIGS. 1 and 2 of this application, a new pole section 36 has an upper end 37 onto which is mounted a turnbuckle connector generally designated 38. The old pole section is severed at 41 and it has a lower end 42 which is being moved into the connector 38 under guidance from a workman 22. Depending on which of the embodiments of this invention is involved, the workman 22 then completes the connection. The workman 22 uses conventional means for supporting himself as he performs his work and he is assisted by a truck boom (not shown).

Figure 3:
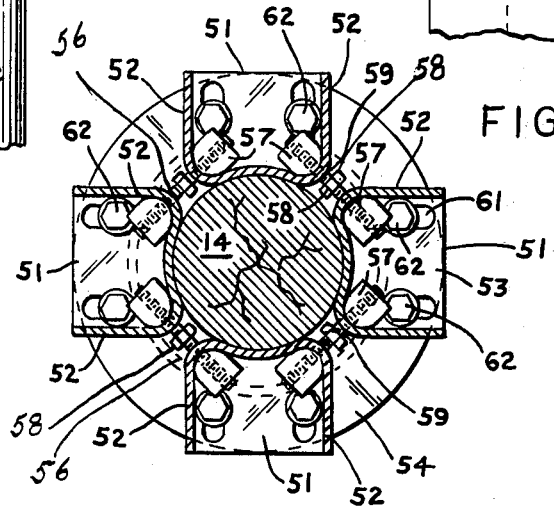
FIG. 3 is a sectional view taken along line 3—3 of FIG. 2.

In the embodiment shown in FIGS. 1–3 a new pole section 36 of reinforced concrete supports a distal section 14 of wood, accordingly upper girdle plates 51 with side margin flanges 52 and terminal flanges 53 are provided for the wooden distal section 14. A base flange 54 mounted on an apron 55 is connected to the reinforced concrete new pole section 36 by casting or grouting as is well known in the art.

The turnbuckles 59 are comprised of oppositely threaded screws 56 which penetrate threadably through special nuts 57 located inside the side margin flanges 52. The screws 56 are provided with a turnable nut 58 whereby turning the nut 58 in one rotational sense causes threads 56 to pull on the side margin flanges 52 moving them closer together and causing the girdle plates 51 to grip the wooden distal section 14. Of course turning the nut 58 in an opposite rotational sense causes the threads 56 to push on the side margin flanges 52 moving them apart. When lifting of the distal section 14 is a problem, all or some of the girdle plates 51 can be left off the new pole section 36 until the distal section 14 is seated thereon.

To allow adjustment of the girdle plates 51 in gripping the wood distal section 14, the terminal flanges 53 are provided with slotted bolt holes 61. Long axes of the slotted bolt holes 61 are parallel to radial axes of the girdle plates 51. Bolts 62 pass through conventional bolt holes 63 in the base flanges 54 and the girdle plates 51 then through the slotted bolt holes 61. Thereafter the bolts are tightened to firm the connection. It should be apparent that the slotted bolt holes 61 could be located in the base flanges 54 only or that the terminal flanges 53 and the base flanges 54 could both be provided with slotted bolt holes 61.

Figure 4:
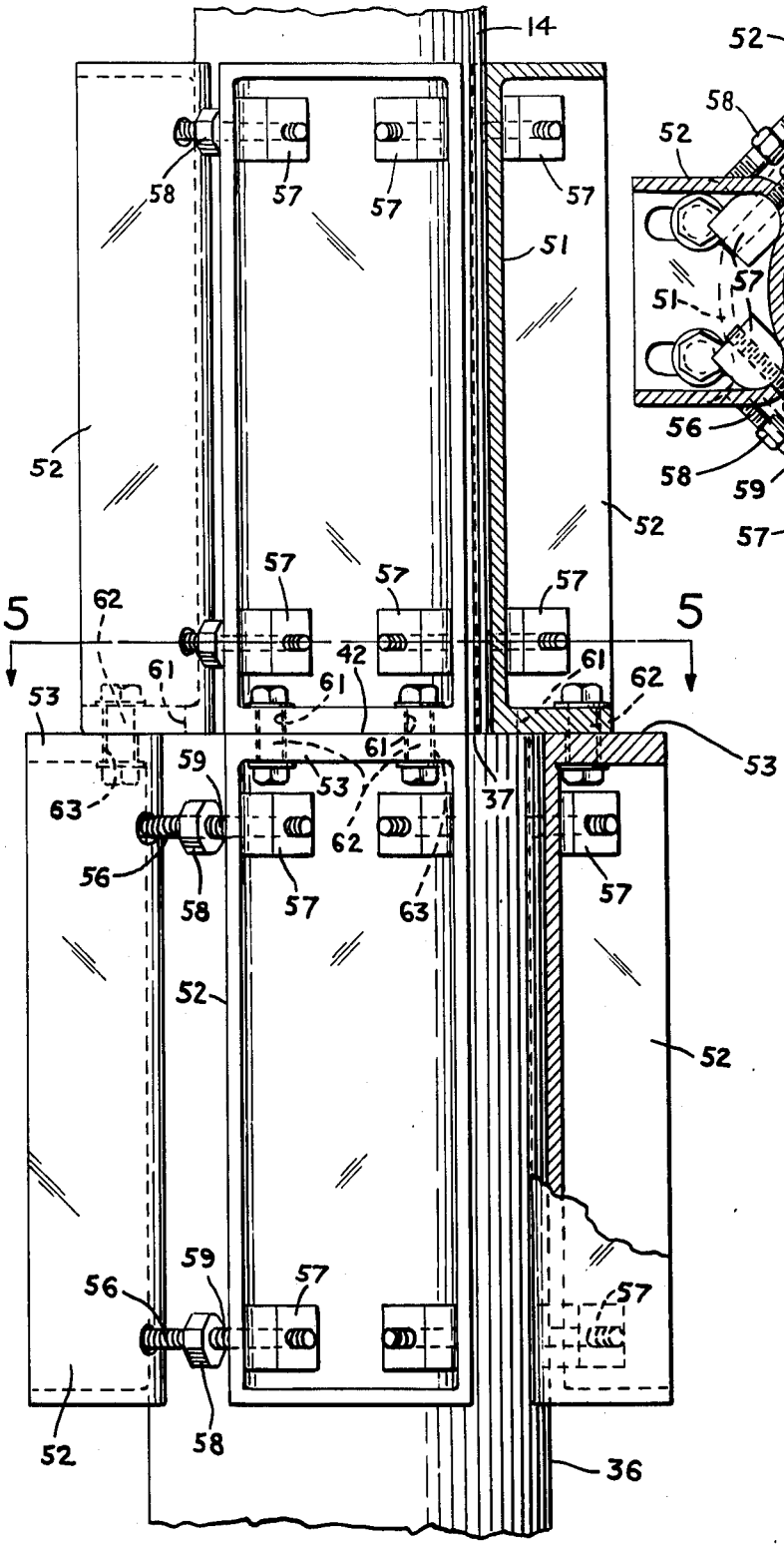
FIG. 4 is a partially broken sectional view of a second embodiment of a turnbuckle connector according to this invention with girdle plates and turnbuckles provided both on a wooden distal section and a wooden new pole section.
Figure 5:
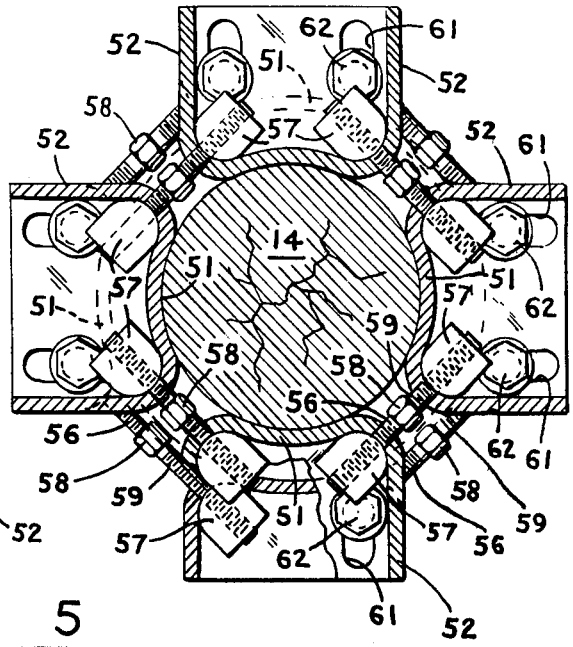
FIG. 5 is a sectional view taken along line 5—5 of FIG. 4.

In the embodiment shown in FIGS. 4–5 a new pole section 36 of wood supports a distal section 14 of wood, accordingly upper and lower girdle plates 51, with side margin flanges 52 and terminal flanges 53, are provided. Radially slotted bolt holes 61 are formed in either of the terminal flanges.

Various materials for poles and connectors may be interchanged according to this invention as can be materials used for grouting, gluing and the like within the context of this invention. It will be apparent also to those skilled in manufacturing, erecting and repairing utility poles that wide deviations may be made from the shown embodiments, without departing from a main theme of invention delineated in claims which follow. It should be apparent to those skilled in the art of designing mechanical devices of this type that the number of girdle plates and the dimensions of the various elements can be varied depending upon relative sizes of poles to be connected and magnitudes of forces to be resisted.

We claim:

1. A turnbuckle connector useable in a method for replacing an existing utility pole, said existing pole comprising a proximal section having a bottom end attached to the earth and a distal section having hardware mounted thereon, without disturbing the hardware, said method comprising the steps of severing the distal section from the proximal section, thereby providing the distal section with a lower end, temporarily supporting the severed distal section, removing the proximal section, providing a new pole section having an upper end, attaching the new pole section to the earth in position to replace this existing proximal section in end-abutting relation to said distal section, and connecting the distal section to the new proximal section in end-abutting relation;

said turnbuckle connector comprising:

an end-embracing unit adapted to surround and grip a portion of a first pole section to be joined in end-abutting relation to a second pole section, adjacent the end of said first pole section to be so joined, said end-embracing unit being provided with a first radially-projecting flange adjacent said end to be joined, a second radially-projecting flange secured in fixed relationship to said second pole section adjacent the end thereof to be joined to said first pole section, and means for rigidly securing said first radially-projecting flange to said second radially-projecting flange;

said end-embracing unit comprising a plurality of girdle plates, each of said girdle plates having a radially-projecting flange portion, said flange portions cooperating to form said first radially-projecting flange, said end-embracing unit further comprising at least one turnbuckle adapted to secure said girdle plates in clamping circumferential disposition with respect to said first pole section.

2. A turnbuckle connector useable in a method for replacing an existing utility pole, said existing pole comprising a proximal section having a bottom end attached to the earth and a distal section having hardware mounted thereon, without disturbing the hardware, said method comprising the steps of, severing the distal section from the proximal section, thereby providing the distal section with a lower end, temporarily supporting the severed distal section, removing the proximal section, providing a new pole section having an upper end, attaching the new pole section to the earth in position to replace the existing proximal section in end-abutting relation to said distal section and connecting the distal section to the new proximal section in end-abutting relation;

said turnbuckle connector comprising:

a first end-embracing unit adapted to surround and grip a portion of a first pole section to be joined in end-abutting relation to a second pole section adjacent the end of said first pole secton to section so joined, said first end-embracing unit being provided with a first radially projecting flange adjacent said end of said first pole section to be joined, a second end-embracing unit adapted to surround and grip a portion of said second pole section adjacent the end of said second pole section to be so joined, said second end-embracing unit being provided with a second radially projecting flange adjacent said end of said second pole section to be joined, and means for rigidly securing said first radially-projecting flange to said second radially-projecting flange;

each of said first and second end-embracing units comprising a plurality of girdle plates, each of said girdle plates having a radially-projecting flange portion, said flange portions of said first end-embracing unit cooperating to form said first radially-projecting flange and said flange portions of said second end-embracing unit cooperating to form said second radially-projecting flange, each of said first and second end-embracing units further comprising at least one turnbuckle adapted to secure said girdle plates in circumferential clamping disposition with respect to the pole end portions respectively surrounded by said first and second end-embracing units.

3. The turnbuckle connector of claim 1 with four of said girdle plates.

4. The turnbuckle connector of claim 1 with two turnbuckles connecting adjacent girdle plates.

5. The turnbuckle connector of claim 1 with:

the second terminal flange having slotted openings, bolts passing through the slotted openings to serve as the attachment means.

6. The turnbuckle connector of claim 2 with four of said girdle plates around each of the sections.

7. The turnbuckle connector of claim 2 with two turnbuckles connecting each of the side marginal flanges to the side marginal flange of an adjacent of the girdle plates.

8. The turnbuckle connector of claim 2 with:

the terminal flanges of the girdle plates of one of the sections having slotted openings, bolts passing through the slotted openings to serve as the attachment means.

* * * * *

UNITED STATES PATENT AND TRADEMARK OFFICE

CERTIFICATE OF CORRECTION

PATENT NO. : 4,048,779

DATED : September 20, 1977

INVENTOR(S) : Frank P. Valenziano and Daniel E. Olivier

It is certified that error appears in the above-identified patent and that said Letters Patent are hereby corrected as shown below:

In Column 1, line 53, delete [a].

In Column 5, line 33, delete [secton to section] and insert therefor section to be .

In Column 5, line 35, insert a hyphen (-) between radially and projecting. Should read radially-projecting.

In Column 6, line 1, insert a hyphen (-) between radially and projecting. Should read radially-projecting.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*